US012553199B2

(12) United States Patent
Chen et al.

(10) Patent No.: US 12,553,199 B2
(45) Date of Patent: Feb. 17, 2026

(54) PRESTRESSED STRENGTHENING APPARATUS FOR PREFABRICATED HIGHWAY BRIDGE

(71) Applicant: CHANG'AN UNIVERSITY, Xi'an (CN)

(72) Inventors: Shizhi Chen, Xi'an (CN); Tao Wang, Xi'an (CN); Fei Yang, Xi'an (CN)

(73) Assignee: CHANG'AN UNIVERSITY, Xi'an (CN)

( * ) Notice: Subject to any disclaimer, the term of this patent is extended or adjusted under 35 U.S.C. 154(b) by 251 days.

(21) Appl. No.: 18/399,539

(22) Filed: Dec. 28, 2023

(65) Prior Publication Data

US 2025/0027282 A1 Jan. 23, 2025

(30) Foreign Application Priority Data

Jul. 19, 2023 (CN) ..... 202310883388.3

(51) Int. Cl.
*E01D 22/00* (2006.01)

(52) U.S. Cl.
CPC ..... *E01D 22/00* (2013.01)

(58) Field of Classification Search
None
See application file for complete search history.

(56) References Cited

FOREIGN PATENT DOCUMENTS

| | | | | | |
|---|---|---|---|---|---|
| CN | 2712994 | | | 7/2005 | |
| CN | 201695347 | | | 1/2011 | |
| CN | 108643061 | A | * | 10/2018 | ..... E01D 22/00 |
| CN | 214656477 | | | 11/2021 | |
| CN | 113774817 | A | * | 12/2021 | ..... E02D 19/04 |
| CN | 218492319 | | | 2/2023 | |
| CN | 218540455 | | | 2/2023 | |
| CN | 116732904 | A | * | 9/2023 | ..... E01D 22/00 |
| CN | 119571740 | A | * | 3/2025 | ..... E01D 22/00 |
| KR | 100880708 | B1 | * | 2/2009 | ..... E01D 22/00 |
| KR | 101889923 | | | 8/2018 | |

* cited by examiner

*Primary Examiner* — Christopher J Sebesta
*Assistant Examiner* — Katherine J Chu
(74) *Attorney, Agent, or Firm* — NZ Carr Law Office

(57) ABSTRACT

The present disclosure provides a prestressed strengthening apparatus for a prefabricated highway bridge. The prestressed strengthening apparatus includes a first mounting frame in a length direction of a strengthening component. The first mounting frame is provided with a sliding table in a length direction, a sliding block of the sliding table is provided with a bi-directional hydraulic cylinder perpendicular to a width direction of the first mounting frame, output ends of the bi-directional hydraulic cylinder are provided with a first connecting block parallel to a height direction of the first mounting frame respectively, the first connecting blocks arranged on two sides are provided with a left sliding rod and a right sliding rod respectively, one end of the left sliding rod is slidably sleeved with one end of the right sliding rod, and a second connecting block, parallel to the first connecting blocks, is arranged at the other end of the left sliding rod and the right sliding rod respectively.

7 Claims, 4 Drawing Sheets

PRESTRESSED STRENGTHENING APPARATUS FOR PREFABRICATED HIGHWAY BRIDGE

TECHNICAL FIELD

The present disclosure belongs to the field of strengthening technologies for highway bridges, and particularly relates to a prestressed strengthening apparatus for a prefabricated highway bridge.

BACKGROUND

With the rapid development of the traffic scale in China, about 70% of concrete bridges in China have entered an overload service period, and many bridges have entered a repair and strengthening period. Moreover, a large number of bridges in short-term service are also damaged, resulting in more strengthening and repair projects for the bridges in China. Such phenomenon also occurs in prefabricated highway or prefabricated bridge projects in the field.

At present, there are two common strengthening methods for prefabricated highways or prefabricated bridges: the first method is to use a passive stress mode of sticking a steel plate, or bonding a carbon fiber plate or fiber sheet; and the second method is to use prestress, especially an external prestress technology, for active stress strengthening.

As shown in Patent No. CN201610963503.8 "PRESTRESSED STRENGTHENING APPARATUS FOR CONCRETE STRUCTURE USING CFRP SHEET", which discloses a technology of applying prestress to a carbon fiber sheet and then bonding it to a bridge or a highway that needs to be strengthened, so as to improve a bearing capacity of a bridge deck or a highway slab. However, in this apparatus or in the existing technology, when mounting the carbon fiber sheets, it is necessary to punch holes in specified positions on the bridge deck or the highway slab according to a number of the carbon fiber sheets, mount pre-tightening apparatuses and clamping apparatuses with the same number as the carbon fiber sheets and the like, which may lead to a long strengthening period and low construction efficiency. In addition, too many holes punched in the bridge deck or the highway slab may also damage the bridge deck or the highway slab to a certain extent. Therefore, it is urgent to provide an apparatus that is efficient in construction and less likely to damage the bridge or the highway.

SUMMARY

In view of the above, an objective of the present disclosure is to provide a prestressed strengthening apparatus for a prefabricated highway bridge, aiming to solve the problems of low construction efficiency and causing damage to a bridge or a highway during a strengthening operation with a prestressed strengthening apparatus in the existing technology.

In order to achieve the above objective, the present disclosure provides the following technical solution:

A prestressed strengthening apparatus for a prefabricated highway bridge of the present disclosure includes a first mounting frame in a length direction of a strengthening component, where the first mounting frame is provided with a sliding table in a length direction; a sliding block of the sliding table is provided with a bi-directional hydraulic cylinder perpendicular to a width direction of the first mounting frame; output ends of the bi-directional hydraulic cylinder are provided with a first connecting block parallel to a height direction of the first mounting frame respectively; the first connecting blocks arranged on two sides are provided with a left sliding rod and a right sliding rod respectively; one end of the left sliding rod is slidably sleeved with one end of the right sliding rod; a second connecting block, parallel to the first connecting blocks, is arranged at the other end of the left sliding rod and the right sliding rod respectively; the second connecting blocks are provided with a hydraulic push rod respectively; a first clamping plate is arranged at an end part of the hydraulic push rod; a second clamping plate detachably connected to the first clamping plate is arranged on a surface of the first clamping plate; and the first clamping plate and the second clamping plate are perpendicular to the width direction of the first mounting frame.

Further, polished rods are symmetrically arranged above the left sliding rod and the right sliding rod; third connecting blocks are arranged at two end parts of each of the polished rods respectively, and connect the polished rods to the second connecting blocks; sliding plates are arranged between the symmetrically arranged polished rods at both ends; a telescopic roller mechanism perpendicular to the sliding plate is arranged on an upper surface of the sliding plate; reset springs are arranged between the sliding plates at the two ends, and are sleeved on the polished rods, with two ends each of the reset springs tightly contacted to the sliding plates; the sliding block is further provided with a second mounting frame; a mounting plate is arranged at an upper end of the second mounting frame, located above the first mounting frame, and provided with at least one driving motor; and a first wire winding wheel and a second wire winding wheel are arranged at an output end of the driving motor, and are each provided with a pull rope with one end fixedly connected thereto, and the other end fixedly connected to the sliding plate.

Further, the telescopic roller mechanism is arranged between the first clamping plates on the two sides, and includes an outer sleeve, an inner sliding rod, a slider, a telescopic spring and a pressure roller; the outer sleeve is fixed to the sliding plate; the slider is slidably connected within the outer sleeve; one end of the inner sliding rod is fixedly connected to the slider, and the other end of the inner sliding rod is fixedly connected to the pressure roller; and the telescopic spring is arranged in the outer sleeve, with one end of telescopic spring fixedly connected to an inner side surface of one end of the outer sleeve connected to the sliding plate and the other end of telescopic spring fixed to a surface of the slider.

Further, the first clamping plate is provided with a supporting plate for placement of the pressure roller; and the supporting plate is fixed to a side surface of the first clamping plate.

Further, a friction layer for increasing friction force is arranged on a side surface of the first clamping plate and a side surface of the second clamping plate in contact with each other. Further, the first clamping plate is connected to the second clamping plate by means of a bolt.

Further, two ends of the first mounting frame are fixed to the strengthening component by means of a high-strength bolt.

Further, the strengthening component is a pavement of a prefabricated highway or a deck of a prefabricated bridge.

The present disclosure has the beneficial effects that:

(1) The prestressed strengthening apparatus can perform a prestressed strengthening operation on the pavement of the highway or the deck of the bridge, to improve its force bearing performance. (2) In the technical solution, the first mounting frame, the sliding table and the bi-directional hydraulic cylinder are arranged such that the bi-directional hydraulic cylinder can move in the width direction of the bridge deck. Furthermore, the first clamping plate and the second clamping plate are arranged to be capable of clamping two ends of the carbon fiber sheet, and in cooperation with stretching of the output ends of the bi-directional hydraulic cylinder, an end part of the carbon fiber sheet can be stretched to an end part of the strengthening component in the length direction. Therefore, the carbon fiber sheet can be arranged in the length direction of the bridge deck to strengthen the bridge deck only by means of movement, which simplifies a strengthening process and increases a strengthening efficiency (without punching too many holes and mounting a pre-tightening component and a clamping component). (3) The telescopic roller mechanism is arranged to repeatedly roll the carbon fiber sheet bonded to the strengthening component, which improves the bonding and fixing effect of the carbon fiber sheet on the strengthening component.

Other advantages, objectives and features of the present disclosure will be set forth in the description which follows, and in part will be apparent to those skilled in the art, or may be learned by those skilled in the art from practice of the present disclosure. The objectives and other advantages of the present disclosure will be realized and attained by the following description.

BRIEF DESCRIPTION OF DRAWINGS

In order to make the objectives, technical solutions and advantages of the present disclosure clearer, the present disclosure provides the following drawings for illustration.

REFERENCE NUMERALS

Strengthening Component 1, First Mounting Frame 2, Sliding Table 3, Sliding Block 4, Bi-directional Hydraulic Cylinder 5, First Connecting Block 6, Left Sliding Rod 7, Right Sliding Rod 8, Second Connecting Block 9, Hydraulic Push Rod 10, First Clamping Plate 11, Second Clamping Plate 12, Carbon Fiber Sheet 13, Polished Rod 14, Sliding Plate 15, Third Connecting Block 16, Reset Spring 17, Pull Rope 18, Driving Motor 19, First Wire Winding Wheel 20, Second Wire Winding Wheel 21, Second Mounting Frame 22, Mounting Plate 23, Outer Sleeve 24, Inner Sliding Rod 25, Pressure Roller 26, Supporting Plate 27, Telescopic Spring 28, and Slider 29.

DETAILED DESCRIPTION

Figure 1:
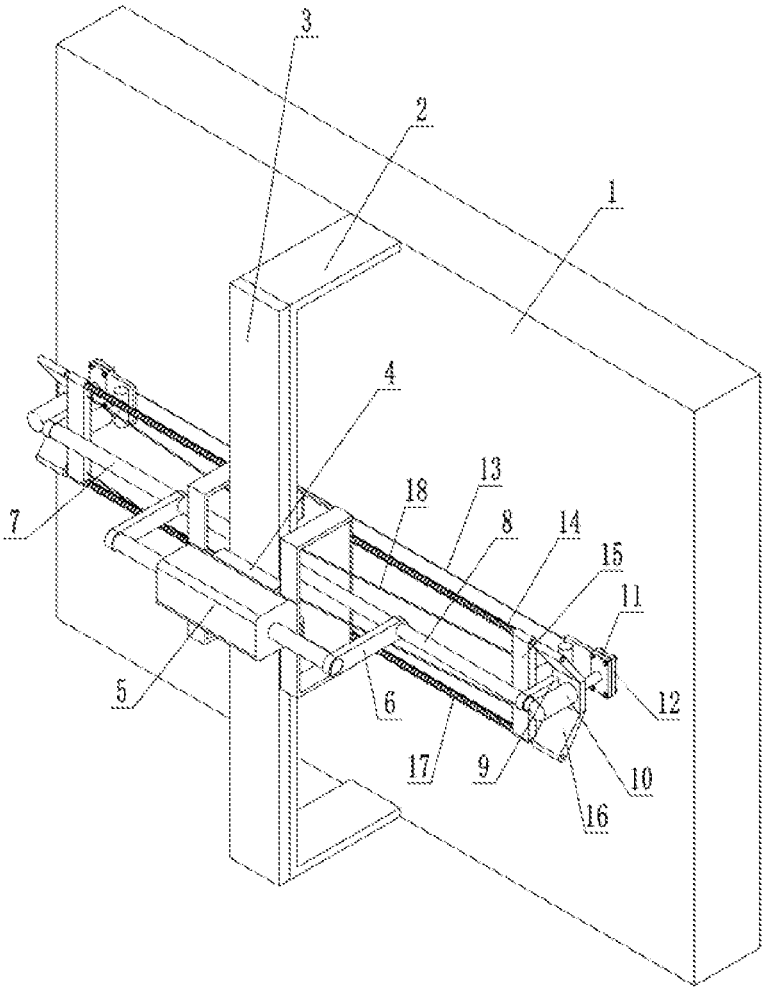
FIG. 1 is a schematic perspective view of the present disclosure mounted on a strengthening component.
Figure 2:
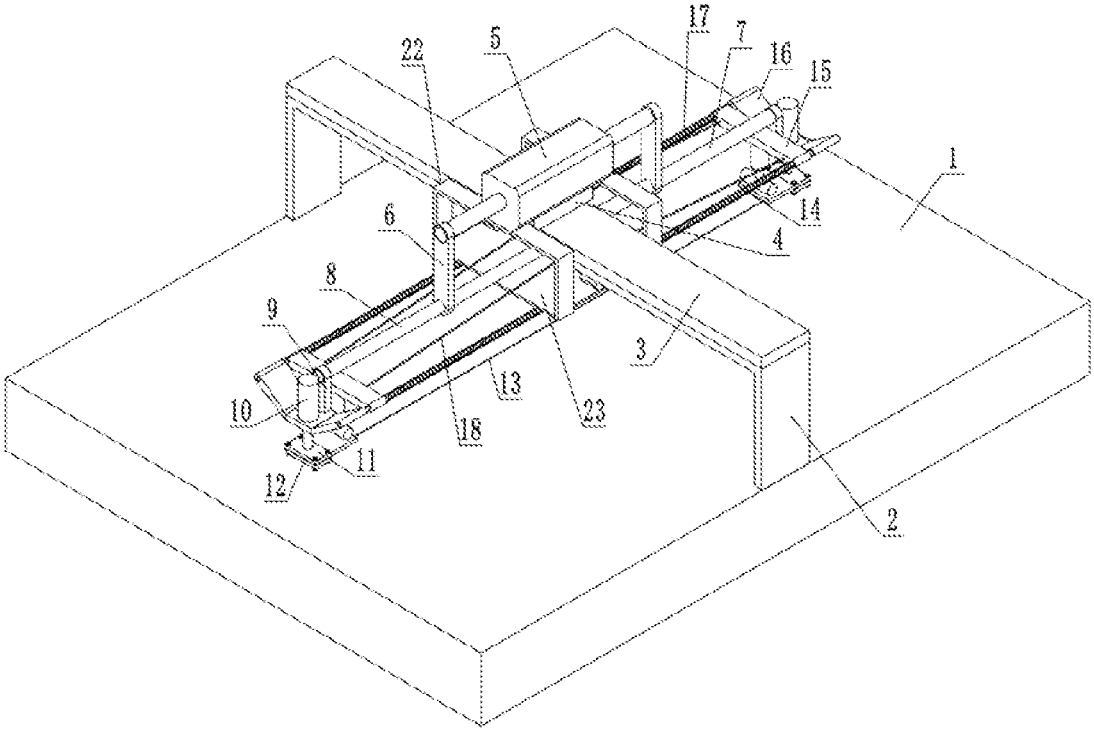
FIG. 2 is a schematic perspective view of the present disclosure in another direction.
Figure 3:
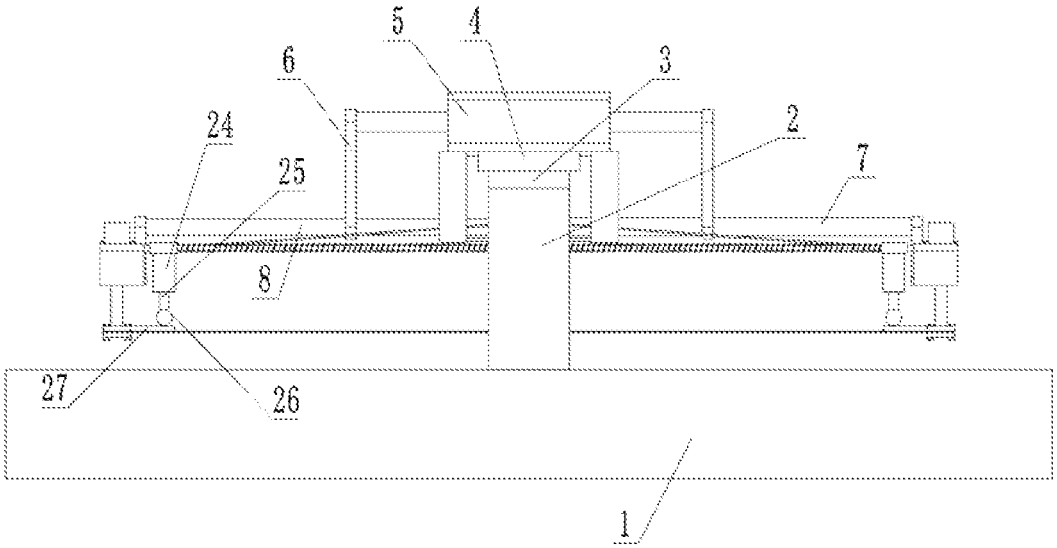
FIG. 3 is a front schematic view of the present disclosure.
Figure 4:
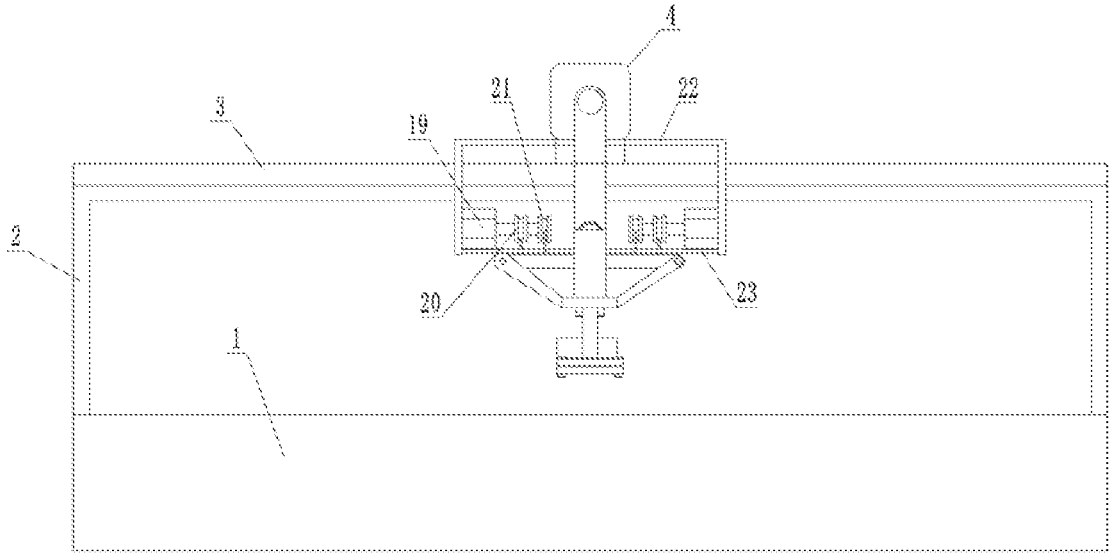
FIG. 4 is a left schematic view of the present disclosure.
Figure 5:
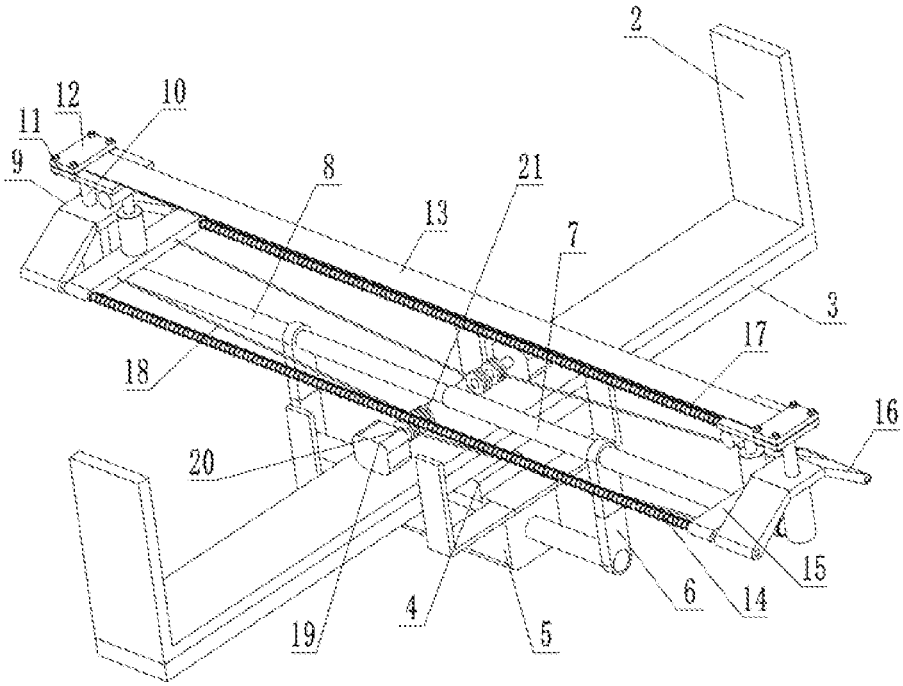
FIG. 5 is a schematic perspective view of the present disclosure with a mounting plate removed.
Figure 6:
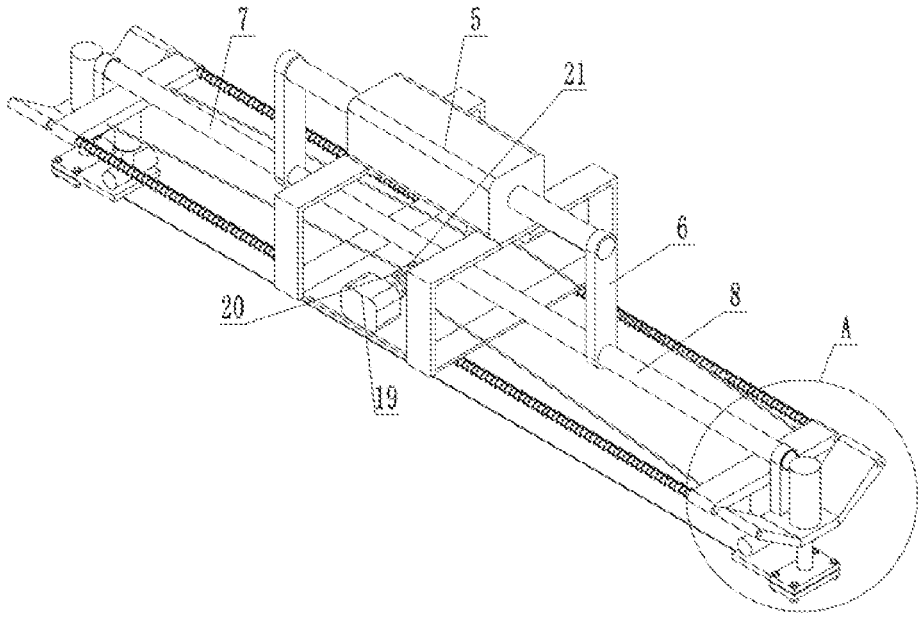
FIG. 6 is a schematic perspective view of the present disclosure with a first mounting frame removed.
Figure 7:
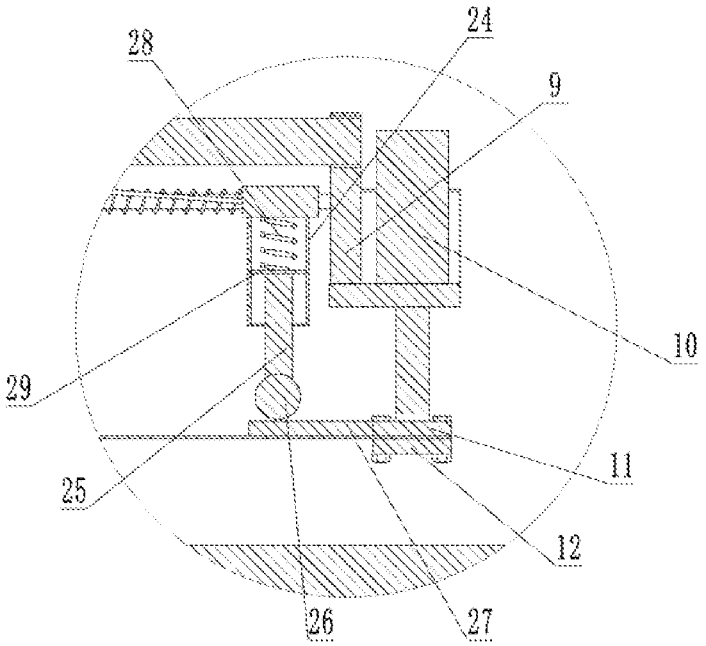
FIG. 7 is a schematic sectional view of a front view of part A in FIG. 6 of the present disclosure.

As shown in FIGS. 1-7, for a prestressed strengthening apparatus for a prefabricated highway bridge of the present disclosure, it is to be noted that a reference object described in an up-down direction in the technical solution is a bridge deck or a pavement, because a plate apparatus is mounted below the bridge deck or the pavement. Therefore, in the technical solution, the direction towards the bridge deck is defined as "up".

The prestressed strengthening apparatus for the prefabricated highway bridge includes: a first mounting frame 2 in a length direction of the strengthening component 1. The first mounting frame 2 is provided with a sliding table 3 in a length direction. A sliding block 4 of the sliding table 3 is provided with a bi-directional hydraulic cylinder 5 perpendicular to a width direction of the first mounting frame 2. Output ends of the bi-directional hydraulic cylinder 5 are provided with a first connecting block 6 parallel to a height direction of the first mounting frame 2 respectively. End parts of the first connecting blocks 6 are fixed to the output ends of the bi-directional hydraulic cylinder 5 by using welding, a flange plate or other connection manners. The first connecting blocks 6 arranged on two sides are provided with a left sliding rod 7 and a right sliding rod 8 respectively. It is to be noted that one of the left sliding rod 7 and the right sliding rod 8 is a hollow rod, and the other may be slidably connected within the hollow rod. One end of the left sliding rod 7 is slidably sleeved with one end of the right sliding rod 8, and a second connecting block 9, parallel to the first connecting blocks 6, is arranged at the other end of the left sliding rod 7 and the right sliding rod 8 respectively. The second connecting blocks 9 are in an "L" shape in embodiments of the present disclosure. The second connecting blocks 9 are provided with a hydraulic push rod 10 on a transverse end surface respectively. A first clamping plate 11 is arranged at an end part of the hydraulic push rod 10, with a middle part of the hydraulic push rod 10 fixed to an output end of the hydraulic push rod 10. A second clamping plate 12 detachably connected to the first clamping plate 11 is arranged on the surface of the first clamping plate 11. The first clamping plate 11 and the second clamping plate 12 are perpendicular to the width direction of the first mounting frame 2.

The working principle of the above technical solution is as follows:

First, the two ends of the first mounting frame 2 in a "mouth" shape are fixedly connected to the bridge deck in the width direction by means of the high-strength bolts. Then, the sliding table 3, which may be an electric sliding table 3 or a hydraulic sliding table 3, is mounted on a horizontal body frame of the first mounting frame 2, and. After that, the bi-directional hydraulic cylinder 5 is fixedly connected to the sliding block 4 of sliding table 3, and then, subsequent components are mounted and connected. When a carbon fiber sheet 13 is used for strengthening, first, two ends of the carbon fiber sheet 13 are each clamped between a first clamping plates 11 and a second clamping plates 12, and then the bi-directional hydraulic cylinder 5 is started after clamping. When the bi-directional hydraulic cylinder 5 extends, it will drive the carbon fiber sheet 13 to be elongated, making the carbon fiber sheet 13 locally prestressed in advance. After the carbon fiber sheet 13 reaches a specified position, the carbon fiber sheet 13 is attached to the bridge deck by means of a downward effect of the hydraulic push rod 10, to achieve bonding. After firm bonding, the first clamping plates 11 and the second clamping plates 12 can be released.

It is to be noted that during movement of the bi-directional hydraulic cylinder 5, the bi-directional hydraulic cylinder 5 may be retracted first, to make one end of the carbon fiber sheet 13 fixed to the first clamping plate 11 and the second clamping plate 12 on one side (during movement, adhesive is applied on the carbon fiber sheet 13). Then, after the bi-directional hydraulic cylinder moves to the specified position, the carbon fiber sheet 13 on the other side is fixed and stretched. Of course, pre-stretching may be performed once before applying the adhesive, to avoid the problem of uneven distribution of the adhesive after stretching due to direct applying of the adhesive.

Such arrangement has the main advantages that: a plurality of carbon fiber sheets 13 used for strengthening can be moved in the width direction of the bridge deck by means of movement of the sliding table 3. In a traditional method, once strengthening is performed, it is necessary to punch a hole in the bridge deck, and mount the components for clamping and stretching the end parts of the carbon fiber sheets 13. Such a method is troublesome to operate, is long in construction period, has more punching and anchoring operations, and is also prone to damaging the bridge deck.

Polished rods 14 are symmetrically arranged above the left sliding rod 7 and the right sliding rod 8. Third connecting blocks 16 are arranged at two end parts of each of the polished rods 14 respectively, and connect the polished rods 14 to the second connecting blocks 9. Sliding plates 15 are arranged between the symmetrically arranged polished rods 14 at both ends. A telescopic roller mechanism perpendicular to the sliding plate 15 is arranged on an upper surface of the sliding plate 15. Reset springs 17 are arranged between the sliding plates 15 at the two ends, and are sleeved on the polished rods 14, with two ends of each of the reset springs 17 tightly contacted to the sliding plates 15. The sliding block 4 is further provided with a second mounting frame 22. A mounting plate 23 is arranged at an upper end of the second mounting frame 22, located above the first mounting frame 2, and provided with at least one driving motor 19. A first wire winding wheel 20 and a second wire winding wheel 21 are arranged at an output end of the driving motor 19, and are each provided with a pull rope 18 with one end fixedly connected thereto, and the other end fixedly connected to the sliding plate 15. The second mounting frame 22 is a rectangular connecting frame symmetrically arranged on two sides of the sliding block 4, with the other end fixedly connected to the mounting plate 23. It is to be noted that the driving motor may be powered by a generator or by mains.

Under the effect of the driving motor 19, the telescopic roller mechanisms may move toward middle parts of the polished rods 14. At the time of movement, due to a contact between pressure rollers 26 and the carbon fiber sheet 13, a pressure can be applied to a bonding part, to improve the bonding effect. The reset springs 17 have the effect that if the driving motor 19 loses traction to the pull ropes 18, deformation reset of the reset springs 17 drives the sliding plates 15 back to initial positions. It will be understood that a part below the first mounting frame 2 may not be compressed by the pressure rollers 26, and this part may be manually pressurized. Preferably, the pull ropes 18 are steel wire ropes.

The telescopic roller mechanism is arranged between the first clamping plates 11 on the two sides, and includes an outer sleeve 24, an inner sliding rod 25, a slider 29, a telescopic spring 28 and the pressure roller 26. The outer sleeve 24 is fixed to the sliding plate 15. The slider 29 is slidably connected within the outer sleeve 24. One end of the inner sliding rod 25 is fixedly connected to the slider 29, and the other end of the inner sliding rod 25 is fixedly connected to the pressure roller 26. The telescopic spring 28 is arranged in the outer sleeve 24, with one end of telescopic spring 28 fixedly connected to an inner side surface of one end of the outer sleeve 24 connected to the sliding plate 15 and the other end of telescopic spring 28 fixed to a surface of the slider 29.

The telescopic roller mechanism operates in such a way that under the effect of the telescopic spring 28, the pressure roller 26 can always make a contact to and compress the carbon fiber sheet 13, which further improves the bonding effect.

The first clamping plate 11 is provided with a supporting plate 27 for placement of the pressure roller 26. The supporting plate 27 is fixed to a side surface of the first clamping plate 11. When the pressure roller 26 is located in an initial position, the pressure roller 26 is located on the supporting plate 27, and the supporting plate 27 is located below the carbon fiber sheet 13, that is, the pressure roller 26 does not interfere with a movement or an adhesive-applying operation of the carbon fiber sheet 13. During movement of the sliding plate 15, the pressure roller 26 may be departed from the supporting plate 27, then extends under the jacking of the telescopic spring 28, and then makes a contact to and rolls on the carbon fiber sheet 13. During resetting of the reset spring 17, after the pressure roller 26 contacts the supporting plate 27, the pressure roller 26 may move onto the plate 27 under the effect of the reset spring 17. It will be understood that one end of the supporting plate 27 facing the pressure roller 26 may be provided as an inclined surface, to facilitate movement of the pressure roller 26 to climb and reset.

A friction layer for increasing friction force is arranged on a side surface of the first clamping plate 11 and a side surface of the second clamping plate 12 in contact with each other, which improves the clamping effect on the carbon fiber sheet 13. Of course, the first clamping plate 11 and the second clamping plate 12 may be detachably connected by means of a bolt, and may perform a clamping operation by a clamping cylinder, or in a specific implementation, by any other components capable of achieving the clamping operation on the carbon fiber sheet 13.

It is to be noted that the bi-directional hydraulic cylinder 5, the hydraulic push rod 10, the driving motor 19 and other components belong to the existing technology. Whether hydraulic telescopic components or electric telescopic components are used, the design and selection may be made according to actual situations. In implementations of the present disclosure, terms "hydraulic" and the like are used to facilitate understanding, but not to limit their use types. Meanwhile, connection manners of the above components are a common knowledge to those skilled in the art, which will not be repeated herein.

It is finally noted that the above preferred embodiments are only used for illustrating the technical solutions of the present disclosure, and are not intended to limit the technical solutions of the present disclosure. Although the present disclosure has been described in detail by way of the above preferred embodiments, those skilled in the art can understand that various changes in form and details may be made to the technical solutions without departing from the scope of the present disclosure as defined in the claims.

The invention claimed is:

1. A prestressed strengthening apparatus for a prefabricated highway bridge, comprising a first mounting frame in a length direction of a strengthening component, wherein the first mounting frame is provided with a sliding table in a length direction; a sliding block of the sliding table is provided with a bi-directional hydraulic cylinder perpendicular to a width direction of the first mounting frame; output ends of the bi-directional hydraulic cylinder are provided with a first connecting block parallel to a height direction of the first mounting frame respectively; the first connecting blocks arranged on two sides are provided with a left sliding rod and a right sliding rod respectively; one end of the left sliding rod is slidably sleeved with one end of the right sliding rod; a pair of second connecting blocks, parallel to the first connecting blocks, are arranged at the other ends of the left sliding rod and the right sliding rod respectively; the second connecting blocks are provided with a hydraulic push rod respectively; a first clamping plate is arranged at an end part of the hydraulic push rod; a second clamping plate detachably connected to the first clamping plate is arranged on a surface of the first clamping plate; and the first clamping plate and the second clamping plate are perpendicular to the width direction of the first mounting frame, wherein polished rods are symmetrically arranged above the left sliding rod and the right sliding rod; two third connecting blocks are respectively arranged at two opposite ends of the pair of polished rods, and the third connecting blocks connecting the polished rods to the second connecting blocks; two sliding plates are respectively arranged at two opposite ends of the polished rods; a telescopic roller mechanism perpendicular to each sliding plate is arranged on an upper surface of the corresponding sliding plate; reset springs are arranged between the two sliding plates, and are sleeved on the polished rods, with two ends of each of the reset springs tightly contacted to the sliding plates; the sliding block is further provided with a second mounting frame; a mounting plate is arranged at an upper end of the second mounting frame, located above the first mounting frame, and provided with at least one driving motor; and a first wire winding wheel and a second wire winding wheel are arranged at an output end of the driving motor, and are each provided with a pull rope with one end of the pull rope fixedly connected thereto, and the other end of the pull rope fixedly connected to the sliding plate.

2. The prestressed strengthening apparatus for the prefabricated highway bridge according to claim 1, wherein the telescopic roller mechanism is arranged between the first clamping plates on the two sides, and comprises an outer sleeve, an inner sliding rod, a slider, a telescopic spring and a pressure roller; the outer sleeve is fixed to each sliding plate; the slider is slidably connected within the outer sleeve; one end of the inner sliding rod is fixedly connected to the slider, and the other end of the inner sliding rod is fixedly connected to the pressure roller; and the telescopic spring is arranged in the outer sleeve, with one end of the telescopic spring fixedly connected to an inner side surface of one end of the outer sleeve connected to the sliding plate and the other end of the telescopic spring fixed to a surface of the slider.

3. The prestressed strengthening apparatus for the prefabricated highway bridge according to claim 2, wherein the first clamping plate is provided with a supporting plate for placement of the pressure roller; and the supporting plate is fixed to a side surface of the first clamping plate.

4. The prestressed strengthening apparatus for the prefabricated highway bridge according to claim 1, wherein a friction layer for increasing friction force is arranged on a side surface of the first clamping plate and a side surface of the second clamping plate in contact with each other.

5. The prestressed strengthening apparatus for the prefabricated highway bridge according to claim 1, wherein the first clamping plate is connected to the second clamping plate by means of a bolt.

6. The prestressed strengthening apparatus for the prefabricated highway bridge according to claim 1, wherein two ends of the first mounting frame are fixed to the strengthening component by means of a high-strength bolt.

7. The prestressed strengthening apparatus for the prefabricated highway bridge according to claim 1, wherein the strengthening component is a pavement of a prefabricated highway or a deck of a prefabricated bridge.

* * * * *